US010219980B2

(12) United States Patent
Scott et al.

(10) Patent No.: US 10,219,980 B2
(45) Date of Patent: Mar. 5, 2019

(54) WEARABLE MEDICAL CONTAINER

(71) Applicants: Richard Marvin Scott, Madison, WI (US); Ronald Allen Scott, Fort Atkinsin, WI (US)

(72) Inventors: Richard Marvin Scott, Madison, WI (US); Ronald Allen Scott, Fort Atkinsin, WI (US)

( * ) Notice: Subject to any disclaimer, the term of this patent is extended or adjusted under 35 U.S.C. 154(b) by 0 days.

(21) Appl. No.: 15/866,652

(22) Filed: Jan. 10, 2018

(65) Prior Publication Data

US 2018/0193225 A1 Jul. 12, 2018

Related U.S. Application Data

(60) Provisional application No. 62/445,080, filed on Jan. 11, 2017.

(51) Int. Cl.

| | |
|---|---|
| ***A45F 3/14*** | (2006.01) |
| ***A45C 1/00*** | (2006.01) |
| ***A61J 1/03*** | (2006.01) |
| ***B65D 83/04*** | (2006.01) |
| ***A45C 11/24*** | (2006.01) |
| *A45C 11/00* | (2006.01) |

(52) U.S. Cl.

CPC ..... *A61J 1/03* (2013.01); *A45C 11/24* (2013.01); *B65D 83/04* (2013.01); *A45C 2011/007* (2013.01)

(58) Field of Classification Search

USPC ..... 224/222, 219; 206/528, 5.1, 480

See application file for complete search history.

(56) References Cited

U.S. PATENT DOCUMENTS 1,609,481 A * 12/1926 McCarthy ..... A44C 5/003 131/241
1,851,750 A * 3/1932 Cartuschka ..... A45C 11/22 206/101
2,764,201 A * 9/1956 Whippo ..... A45C 11/008 150/111
3,009,614 A * 11/1961 Humphner ..... A44C 5/003 224/219
3,157,326 A * 11/1964 Murphy ..... A44C 5/003 224/219
3,552,610 A * 1/1971 Coleman ..... F42B 39/02 206/38
3,780,918 A * 12/1973 Curtis ..... A44C 5/003 206/5

(Continued)

*Primary Examiner* — Jacob K Ackun
(74) *Attorney, Agent, or Firm* — Dunlap Bennett & Ludwig PLLC

(57) ABSTRACT

A wearable medical container is provided. The wearable medicinal container has a plurality of spaced apart medicament cavities, each separately securable through its own snap-lock configured cavity lid. The plurality of spaced apart medicament cavities may be housed in an enclosure of a container base, which itself may be closed off by a container lid movable between the closed position and an open position for accessing the plurality of spaced apart medicament cavities. Each medicament cavity contains a single medicament dosage, preventing it from being damaged, while making it accessible. Being wearable through an association with a strap, the wearable medical container is useful for urgent critical medicinal administration.

6 Claims, 3 Drawing Sheets

(56) References Cited

U.S. PATENT DOCUMENTS 3,955,726 A * 5/1976 Reitzel ..... A45C 11/005 206/5.1
5,267,650 A * 12/1993 Gilbilisco ..... A61J 1/03 206/534
5,735,406 A * 4/1998 Keffeler ..... A61J 1/03 206/535
5,881,867 A * 3/1999 Tohill, Jr. ..... A45C 11/005 206/316.1
5,938,089 A * 8/1999 Abreu-Marston ..... A45F 3/20 215/382
6,330,961 B1 * 12/2001 Borja ..... A45C 1/04 224/221
7,793,785 B2 * 9/2010 Keffeler ..... A61J 1/03 206/532
7,942,293 B2 * 5/2011 Lawrence ..... A45C 11/008 224/197
8,973,796 B1 * 3/2015 Abusaoud ..... B65D 1/34 224/218
2002/0139708 A1 * 10/2002 Lien ..... B65D 25/10 206/534
2004/0251285 A1 * 12/2004 O'Neill ..... A45F 5/00 224/221
2005/0133382 A1 * 6/2005 Gerard ..... A45C 11/005 206/5.1
2006/0261107 A1 * 11/2006 Daniels ..... A45C 1/04 224/219
2007/0102461 A1 * 5/2007 Carstens ..... A41D 13/005 224/222
2009/0046956 A1 * 2/2009 Redzisz ..... A45C 11/008 383/61.3
2012/0312851 A1 * 12/2012 Rico ..... A45C 1/04 224/576
2013/0206801 A1 * 8/2013 Delgatty ..... A45F 5/00 224/219
2014/0110444 A1 * 4/2014 Austin ..... A45F 5/00 224/219
2014/0117060 A1 * 5/2014 Colone ..... A44C 5/003 224/219
2015/0296963 A1 * 10/2015 Byun ..... A45F 5/02 224/191
2016/0001958 A1 * 1/2016 Hardy ..... A61J 7/0015 426/2

* cited by examiner

WEARABLE MEDICAL CONTAINER

CROSS-REFERENCE TO RELATED APPLICATION

This application claims the benefit of priority of U.S. provisional application No. 62/445,080, filed 11 Jan. 2017, the contents of which are herein incorporated by reference.

BACKGROUND OF THE INVENTION

The present invention relates to medical devices and, more particularly, to a wearable medical container for medicaments.

The administration of certain medicaments is a matter of life of death. For example, nitroglycerin tablets need to be carried by heart patients at all times. Obviously, the availability and accessibility of such medicaments is critical to the patient. Unfortunately, patients often forget, misplace or lose them, making them unavailable to take during emergency, such as angina. Currently there is no wearable container that focuses on complete protection, non-movement and ease of administration for critical medicaments.

Rather current medicine holders are slower to access, and the housed tablets can be lost and/or pulverized and unusable. Specifically, current medicinal containers do not prevent the continued jostling, bouncing and eventual pulverizing of the housed medicament, causing accuracy of potency issues, usability in a medical emergency. Furthermore, current containers take significantly more time to open and retrieve tablets, which in the context of urgently-needed critical medicaments can be very problematic. Multiple tablets can also fall out and be lost when using current medicament holders in medical emergencies.

As can be seen, there is a need for a wearable medical container for critical medicaments, wearable on the wrist of the patient, providing safe, convenient storage of a plurality of medicament dosages for immediate access of one or more dosage during a medical emergency. With the present invention, critical medicament deliverables are easily and quickly accessible yet secured so as to not lose integrity or turn to powder. Specifically, the present invention maintains the integrity of critical medicament.

SUMMARY OF THE INVENTION

In one aspect of the present invention, a wearable medicinal container including a container base adapted to be worn about an appendage of a human wearer; an insert removable attachable to the container base, the insert providing a plurality of spaced apart medicament cavities; and a cavity lid pivotally connected to each medicament cavity so as to be movable between an unsecured condition and a secured condition preventing access to each respective medicament cavity.

In another aspect of the present invention, the wearable medicinal container including a container base adapted to be worn about an appendage of a human wearer; a strap extending from each opposing end of the container base for wrapping about said appendage; an enclosure defined by a bottom wall and a plurality of sidewalls of the container base, wherein the bottom provides a concave shape for adaptively conforming with said appendage; a container lid pivotally connected to the container base so as to be movable between an open position and a closed position closing off access to the enclosure; an insert removable attachable to the container base, the insert providing a plurality of spaced apart medicament cavities, wherein a lower surface of the insert further defines a remaining portion of the enclosure; a seal that operatively engages peripheries of both the enclosure and the insert, the seal having an opening for providing access to the enclosure when the insert has been removed, wherein entire insert is housed in the enclosure; a plurality of tiered protrusions extending into the enclosure from the bottom wall, wherein the plurality of tiered protrusions operatively associates with the insert; a cavity lid pivotally connected to each medicament cavity so as to be movable between an unsecured condition and a secured condition preventing access to each respective medicament cavity; a lid catch adjacent to each medicament cavity; and a lid slot provided by each cavity lid so that the lid catch and the lid slot operatively engage for each medicament cavity in the secured condition.

These and other features, aspects and advantages of the present invention will become better understood with reference to the following drawings, description and claims.

DETAILED DESCRIPTION OF THE INVENTION

Figure 1:
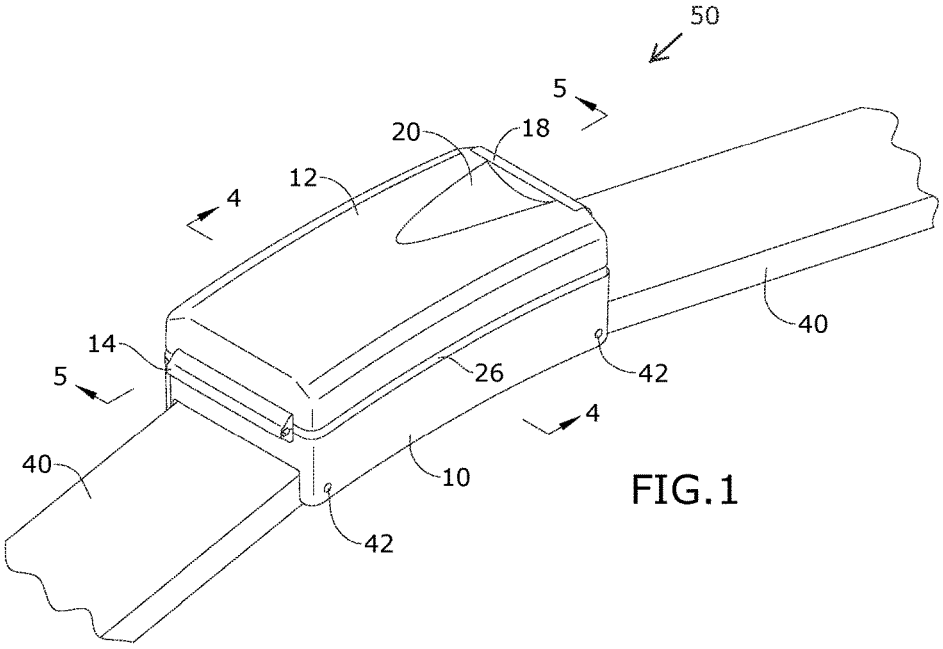
FIG. 1 is a perspective view of an exemplary embodiment of the present invention, shown in a closed position.
Figure 2:
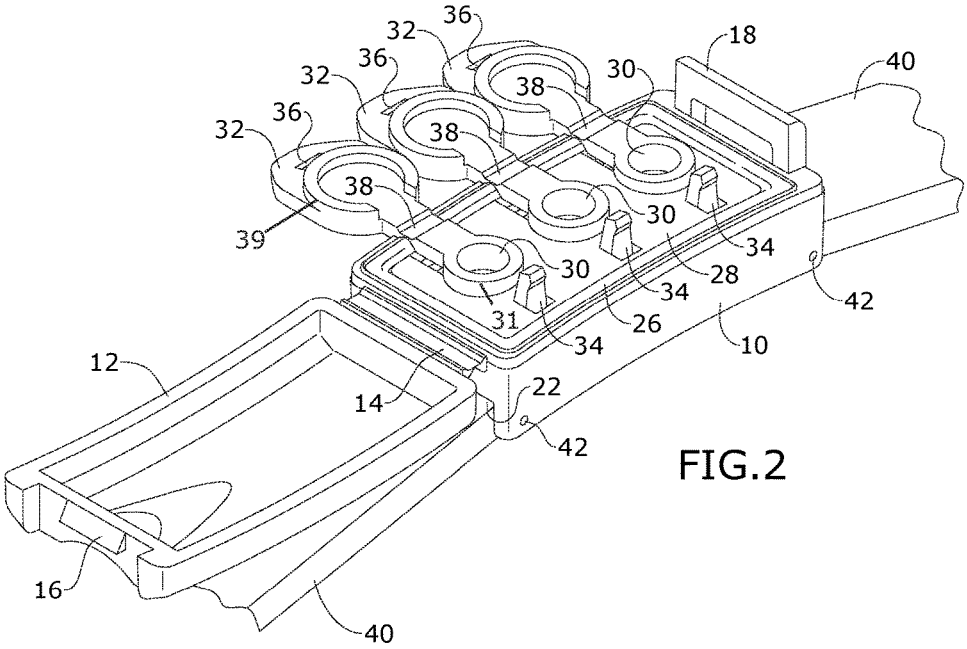
FIG. 2 is a perspective view of an exemplary embodiment of the present invention, shown in an open position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a wearable medical container have a plurality of spaced apart medicament cavities, each separately securable through its own snap-lock configured cavity lid. The plurality of spaced apart medicament cavities may be housed in an enclosure of a container base, which itself may be closed off by a container lid movable between the closed position and an open position for accessing the plurality of spaced apart medicament cavities. Each medicament cavity contains a single medicament dosage, preventing it from being damaged, while making it accessible. Being wearable through an association with a strap, the wearable medical container is useful for urgent critical medicinal administration.

Referring to FIGS. 1 through 5, the present invention may include a wearable medical container 50 having a container lid 12 pivotally connected to a container base 10 by way of a pivotal connection 14 so that the wearable medical container 50 is movable between a closed position and an open position. The wearable medical container 50 may be made of material that is both water resistant and can be repeatedly bent without fracturing, such as polyethylene, polypropylene, vinyl, nylon, rubber, various impregnated or laminated fibrous materials, various plasticized materials and the like. The container lid 12 may provided a first latch component 16, and the container base 10 may provide a second latch component 18, wherein the first and second latch components 16 and 18 are adapted to move between a locked and an unlocked condition when the present invention is in the closed position. The container lid 12 may provide a finger cutout 20 adjacent the second latch component 18 for assisting in moving the container lid 12 between the open and closed positions.

The container base 10 may provide a strap slot 22 and strap pin holes 24 on each opposing end thereof, wherein each strap slot 22 and set of strap pin holes 24 is adapted to receive and pivotal engage an end of a strap 40 and an operatively associated strap pin 42 so that the container 50 may be worn around an appendage of a human wearer of the strap 40, such as a wrist.

Figure 3:
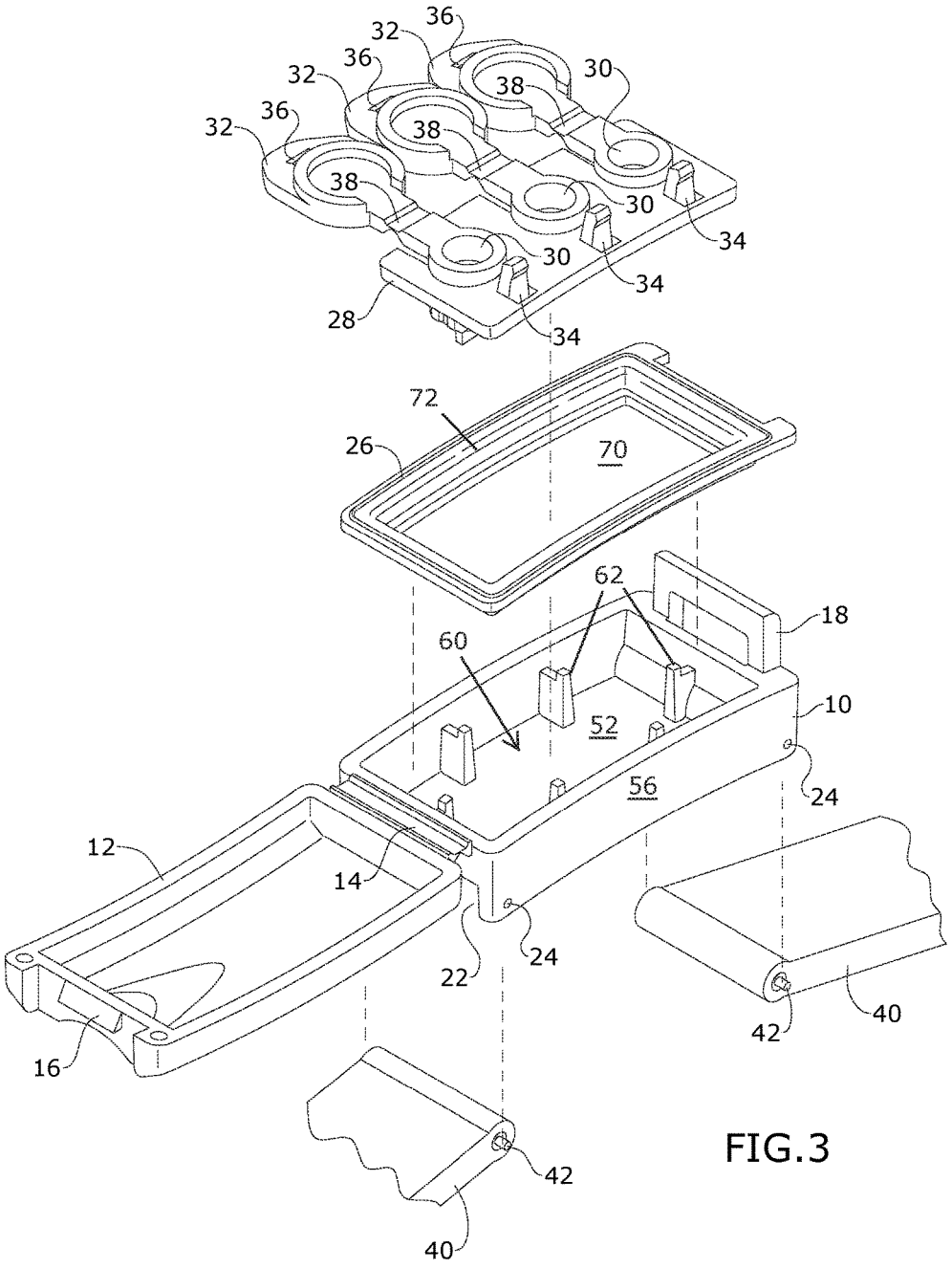
FIG. 3 is an exploded view of an exemplary embodiment of the present invention.
Figure 4:
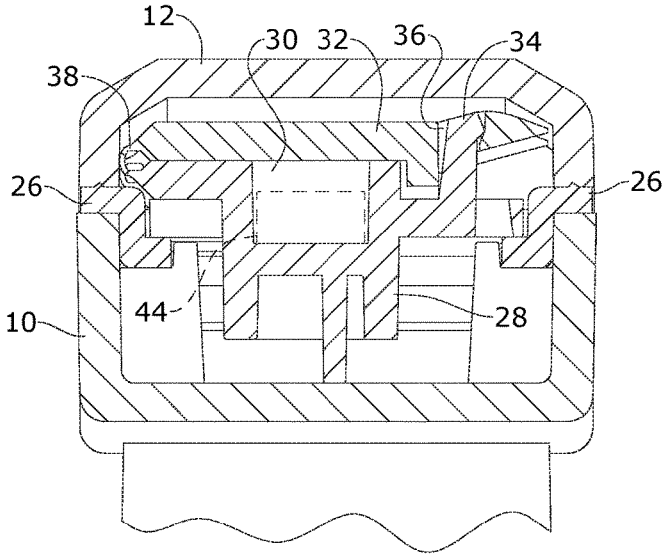
FIG. 4 is a section view of an exemplary embodiment of the present invention, taken along line 4-4 of FIG. 1, with medicament dosage 44 shown in place.
Figure 5:
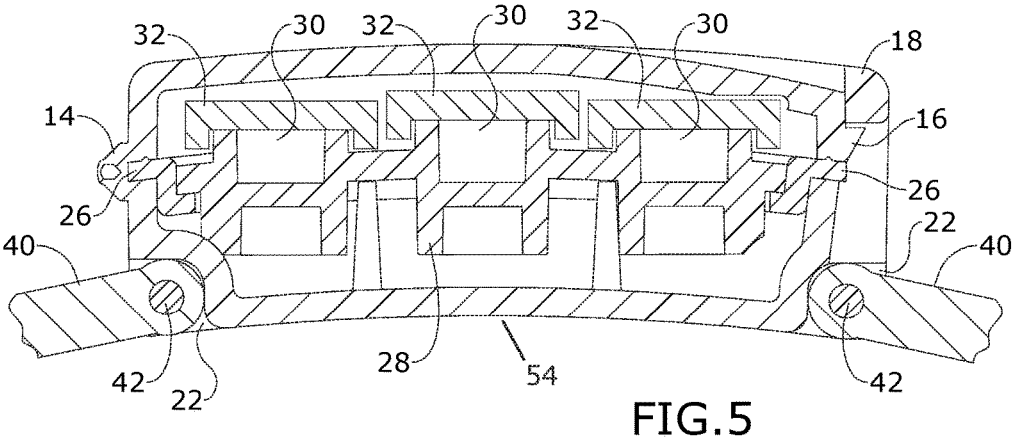
FIG. 5 is a section view of an exemplary embodiment of the present invention, taken along line 5-5 of FIG. 1.

The container base 10 may have an upward-facing surface 52 and a downward-facing surface 54, as illustrated in FIGS. 3 and 5, respectively. It should be understood by those skilled in the art that the use of directional terms such as upper, lower, upward, downward, top and the like are used in relation to the illustrative embodiments as they are depicted in the figures, the upward direction (or upper) being toward the top of the corresponding figures and a downward direction being toward the bottom of the corresponding figure. The downward-facing surface 54 may provide a concave shape, adapted to conform to a curved portion of the appendage of the wearer, such as the wrist.

The upward-facing surface 52 and the sidewalls 56 of the container base 10 may define an enclosure 60. A plurality of tiered protrusions 62 may extend from the upward-facing surface 52 into the enclosure 60. A seal 26 may be adapted to operatively engage a periphery of the enclosure 60 along the sidewalls 56 and the plurality of tiered protrusions 62, yet allow access to the enclosure 69 through an opening 70 of the seal 26, as illustrated in FIG. 3. The periphery of said opening 70 may provide protrusions, ridges, or the like 72 adapted to engage a periphery of an insert 28 so that a portion of the enclosure 60 is available for additional storage.

An upward-facing portion of the insert 28 may provide a plurality of spaced apart medicament cavities 30 defined by cavity sidewalls 31 adapted to be sealed through operative engagement of lid seals 39. The lid seals 39 may be provided by respective cavity lids 32 pivotally connected to the medicament cavities 30 by an insert pivotal connection 38, such as a living hinge, so that each cavity lid 32 is movable between an unsecured and a secured condition securing a single medicament dosage 44 in the associated medicament cavity 30 when the lid seal 39 and cavity sidewalls 31 selectively engage, such as through a snap-lock configuration. The upward-facing portion of the insert 28 may provide a lid catch 34 adjacent to each medicament cavity 30 so that a lid slot 36 provided by each cavity lid 32 operatively engages its respective lid catch 34, further securing the secured condition. The medicament dosage 44 may be a tablet, pill or other form for delivering critical medicament.

A method of using the present invention may include the following. The container 50 disclosed above may be provided. A user may utilize the downward-facing surface 54 and the straps 40 to wear about their wrist, neck or other sufficiently sized appendage to accommodate the container 50. In times of need, the user may move the container lid 12 from the locked condition to the unlocked condition, and then the closed position to the open position in order to access one or more of the medicament cavities 30. Upon accessing the unlocked condition/open position, each cavity 30 will be further secured in the secured condition (otherwise the container lid 12 would not have been able to be in the closed position), and so then the user must separately move each medicament cavity 30 to the unsecured condition by moving the respective cavity lid 32 to access the medicament dosage 44. When in the secured condition, each medicament dosage 44 is safe and secure and continually accessible by the patient with no fear of the medicament dosages 44 being damages or pulverized. The insert 28 may also be removed so that a user may access the remaining portion of the enclosure 60 is available for additional storage, wherein additional medicine may be stored.

It should be understood, of course, that the foregoing relates to exemplary embodiments of the invention and that modifications may be made without departing from the spirit and scope of the invention as set forth in the following claims.

What is claimed is:

1. A wearable medicinal container, comprising:

a container base adapted to be worn about an appendage of a human wearer;

an insert removable attachable to the container base, the insert providing a plurality of spaced apart medicament cavities;

a cavity lid pivotally connected to each medicament cavity so as to be movable between an unsecured condition and a secured condition preventing access to each respective medicament cavity;

an enclosure defined by a bottom wall and a plurality of sidewalls of the container base;

a container lid pivotally connected to the container base so as to be movable between an open position and a closed position closing off access to the enclosure;

a seal that operatively engages peripheries of both the enclosure and the insert, the seal having an opening for providing access to the enclosure when the insert has been removed; and a plurality of tiered protrusions extending into the enclosure from the bottom wall, wherein the plurality of tiered protrusions operatively associates with the insert.

2. The wearable medicinal container of claim 1, wherein a lower surface of the insert further defines a remaining portion of the enclosure.

3. The wearable medicinal container of claim 1, further comprising:

a lid catch adjacent to each medicament cavity; and a lid slot provided by each cavity lid so that the lid catch and the lid slot operatively engage for each medicament cavity in the secured condition.

4. The wearable medicinal container of claim 1, wherein the bottom provides a concave shape for adaptively conforming with said appendage.

5. The wearable medicinal container of claim 1, further comprising a strap extending from each opposing end of the container base for wrapping about said appendage.

6. A wearable medicinal container, comprising:

a container base adapted to be worn about an appendage of a human wearer;

a strap extending from each opposing end of the container base for wrapping about said appendage;

an enclosure defined by a bottom wall and a plurality of sidewalls of the container base, wherein the bottom provides a concave shape for adaptively conforming with said appendage;

a container lid pivotally connected to the container base so as to be movable between an open position and a closed position closing off access to the enclosure;

an insert removable attachable to the container base, the insert providing a plurality of spaced apart medicament cavities, wherein a lower surface of the insert further defines a remaining portion of the enclosure;

a seal that operatively engages peripheries of both the enclosure and the insert, the seal having an opening for providing access to the enclosure when the insert has been removed, wherein entire insert is housed in the enclosure;

a plurality of tiered protrusions extending into the enclosure from the bottom wall, wherein the plurality of tiered protrusions operatively associates with the insert;

a cavity lid pivotally connected to each medicament cavity so as to be movable between an unsecured condition and a secured condition preventing access to each respective medicament cavity;

a lid catch adjacent to each medicament cavity; and a lid slot provided by each cavity lid so that the lid catch and the lid slot operatively engage for each medicament cavity in the secured condition.

* * * * *